United States Patent [19]

Faust et al.

[11] 4,238,256

[45] Dec. 9, 1980

[54] DEVICE AND METHOD FOR APPLYING FLEXIBLE BAILS TO CONTAINERS

[75] Inventors: Michael C. Faust, North St. Paul; Richard A. Patterson, Woodbury, both of Minn.

[73] Assignee: Minnesota Mining and Manufacturing Company, St. Paul, Minn.

[21] Appl. No.: 926

[22] Filed: Jan. 4, 1979

[51] Int. Cl.[2] ..... E06B 9/26

[52] U.S. Cl. ..... 156/65; 156/199; 156/212; 156/263; 156/264; 156/443; 156/459; 156/464; 156/522; 156/552

[58] Field of Search ..... 156/443, 475, 522, 552, 156/476, 481, 65, 434, 459; 229/52 AC, 52 AL, 52 R, 52 A; 215/100 A; 93/35 H, 8 WA

[56] References Cited

U.S. PATENT DOCUMENTS

| | | | |
|---|---|---|---|
| 2,787,567 | 4/1951 | Fisher | 156/434 |
| 3,034,970 | 9/1974 | Mitsuoka | 93/8 WA X |
| 3,186,544 | 6/1965 | Curry et al. | 215/100 A X |
| 3,706,625 | 12/1972 | Jones et al. | 156/552 X |
| 3,773,591 | 11/1973 | Blair | 93/35 H X |
| 3,850,724 | 11/1974 | Lemacher | 156/522 X |
| 4,133,252 | 1/1979 | Eckstein | 93/35 H |

*Primary Examiner*—David A. Simmons

*Attorney, Agent, or Firm*—Cruzan Alexander; Donald M. Sell; William L. Huebsch

[57] ABSTRACT

A device that forms a ladder-like tape assembly, applies the assembly to a series of bottles moving along a conveyor with a transverse tape aligned with each bottle, and then severs the side tapes between the bottles and adheres the severed portions thereto to provide flexible bails for the bottles.

6 Claims, 4 Drawing Figures

DEVICE AND METHOD FOR APPLYING FLEXIBLE BAILS TO CONTAINERS

BACKGROUND OF THE INVENTION

This invention relates to devices for applying flexible bails to containers.

SUMMARY OF THE INVENTION

According to the present invention there is provided an effective device and method for applying flexible bails to containers such as cylindrical bottles containing medical solutions (e.g., intravenous or irrigation solutions) for which the bails are used to support the bottles in inverted positions for distribution of the solutions, which device could alternately be modified for applying bails to other shaped containers for similar use or for use as a handle to carry the container in an upright position.

The device according to the present invention is adapted to apply the bails to bottles being moved by a conveyor, and comprises means for defining generally parallel paths for two lengths of pressure-sensitive adhesive-coated tape first along first path portions spaced from the conveyor, and then along second path portions with the adhesive on the tapes being adjacent the opposite sides of containers and being adhered to the containers along a part of the second path portion so that movement of the containers via the conveyor will pull the tapes along said path. Means are provided along the first path portions for forming elongate bails of a flexible material, which bails have opposite end portions coated with pressure-sensitive adhesive on one surface; together with means for pressing the uncoated surfaces on the end portions of the bails into engagement with the adhesive coatings on the tapes as the tapes move along the path to provide a ladder-like tape and bail assembly. The bails are positioned in predetermined spaced relationships along the tapes so that the end portions of the bails will be positioned on opposite sides of containers being moved by the conveyor, and means are provided for pressing the adhesive coating on the end portions of the bails into engagement with the containers as they are moved by the conveyor. Means are also provided for severing the tapes between the containers along the conveyor and for pressing the severed portions of the tapes into engagement with the containers to complete the application of the bails.

In the device as illustrated, the bails formed have a length that is greater than the distance between the parallel lengths of tape along their first path portions, and the means for pressing the bails into engagement with the tapes includes means for bowing the bails as they are engaged with the tapes.

Also, the means for forming the bails preferably forms them from a pressure-sensitive adhesive-coated web having a width corresponding to the length of the bails desired, and a second web having a width less than that of the first web. Means are provided for laminating the second web centrally on the adhesive-coated surface of the first web, as are means for transversely severing the laminate thus formed to provide the bails.

BRIEF DESCRIPTION OF THE DRAWING

The present invention will be more thoroughly described with reference to the accompanying drawing wherein like numbers refer to like parts throughout the several views, and wherein.

DESCRIPTION OF THE PREFERRED EMBODIMENT

Figure 1:
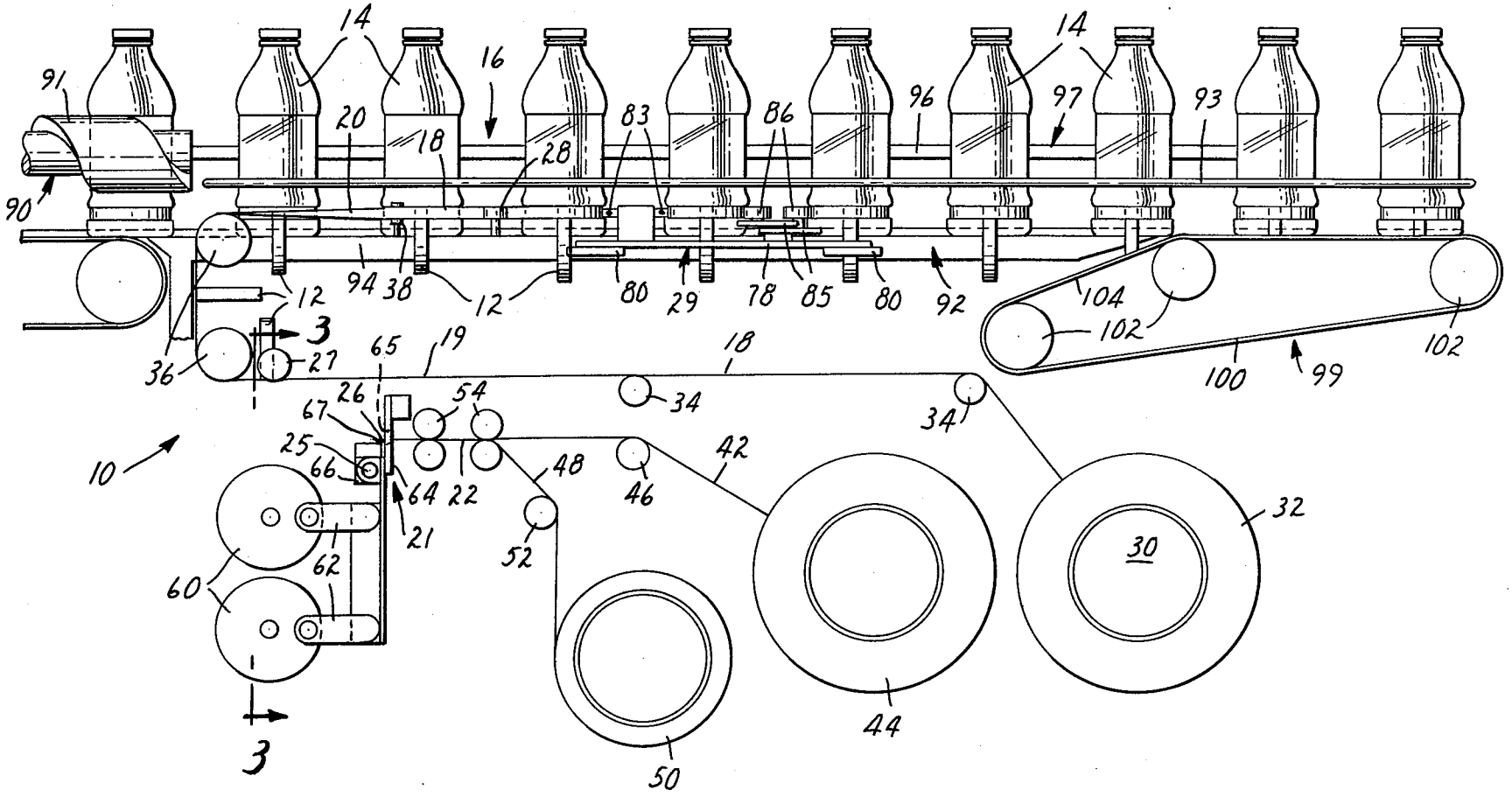
FIG. 1 is a schematic view of a device for applying bails according to the present invention illustrated for use in applying bails to bottles being moved by a conveyor.

Referring now to the drawings, there is illustrated a device according to the present invention, generally designated by the reference numeral 10, which device 10 is adapted for applying bails 12 around the bottom ends of a plurality of containers or bottles 14 being moved in predetermined spaced relationships by a conveyor 16.

Briefly the device comprises:

(1) Means for defining generally parallel paths for two lengths of pressure-sensitive adhesive-coated tape 18 (FIG. 1) first along a first path portion 19 spaced from the conveyor 16 and then along a second path portion 20 with the adhesive coatings on the tapes 18 closely adjacent the opposite sides of the bottles 14 and being adhered to the bottles 14 along a part of the second path portion so that movement of the bottles 14 via the conveyor 16 will pull the tape 18 along the path;

(2) Means including a rotary shear assembly 21 along the first path portion 19 for forming the elongate bails 12 from a length of flexible laminate 22, with the bails 12 having opposite end portions 24 coated with a pressure-sensitive adhesive on one surface;

(3) Means including a mechanism 25 carried by a knife 26 included in the rotary shear assembly 21 for pressing the surfaces of the end portions 24 on the bails 12 opposite the adhesive coating into engagement with the adhesive coatings on the tapes 18 against support rollers 27 as the tapes 18 move along the first portions 19 of their path to form a ladder-like tape 18 and bail 12 assembly, and for positioning the bails 12 in predetermined spaced relationships along the tapes 18 so that the end portions 24 of the bails 12 will be positioned on opposite sides of bottles 14 being moved by the conveyor 16;

(4) Means comprising pressure rollers 28 along the second path portions 20 for pressing the tapes 18 and end portions 24 of the bails 12 into engagement with the bottles 14; and (5) Means including two rotary cutting and pressing assemblies 29 on opposite sides of the conveyor 16 for severing the tapes 18 between the bottles 14 along the conveyor 16, and for pressing the severed portions of the tapes 18 into engagement with the bottles 14.

The means for defining generally parallel paths for the two lengths of tapes 18 comprise for each tape 18 a hub 30 for supporting a supply roll 32 of the tape (only one of which hubs 30 and rolls 32 is shown), two guide rollers 34, and one of the support rollers 27 which guide the tapes 18 with their adhesive coatings generally in a common plane across the support rollers 27 and with the adhesive coating on the side of the tape opposite the rollers 27 to facilitate pressing the bails 12 into engagement with the tapes 18. Also included for each tape 18 are two corner rollers 36 which provide a 180° change in the directions of between the first and second portions 19 and 20 of the tape paths; a guide roller 38 having an axis disposed at 90° with respect to the axis of the adjacent corner roller 36 to provide with the adjacent corner roller 36 means for twisting the tape 90° to position its adhesive-coated surface adjacent the side surface of the bottles 14 being moved by the conveyor 16; and the pressure roller 28 which provides the means for pressing the adhesive-coated surface of the tape 18 and the end portions 24 of the bails 12 adhered thereto into engagement with the sides of the bottles 14 being moved by the conveyor 16.

The means along the first path portion 19 for forming elongate bails 12 from the laminate 22 comprises means for forming the laminate 22 from a length of pressure-sensitive adhesive-coated first web 42 having a width corresponding to the desired length of the bails 12, which first web 42 is supplied from a roller 44 and guided over a guide roller 46; and a second flexible web 48 having a width less than the first web 42, which second web 48 is supplied from a roll 50 and guided around a guide roller 52. The first and second webs 42 and 48 are laminated together between two spaced pairs of nipping rollers 54 with the second web being centrally located on the adhesive-coated side of the first web 42, and are driven via timed rotation of the nipping rollers 54 into the rotary shear assembly 21 which transversely cuts the laminate 22 to form the bails 12 from the end of the laminate 22. The rotary shear assembly 21 comprises the knife 26 which is driven via timed rotation of two pulleys 60 by four links each having one end fixed to the knife 26 and an opposite end pivotably mounted on one of the pulleys 60 to move the knife 26 past an anvil plate 64 when a predetermined length of the laminate of the webs 42 and 48 has been fed through a slot 65 in the anvil plate 64 by the nipping rollers 54.

Figure 4:
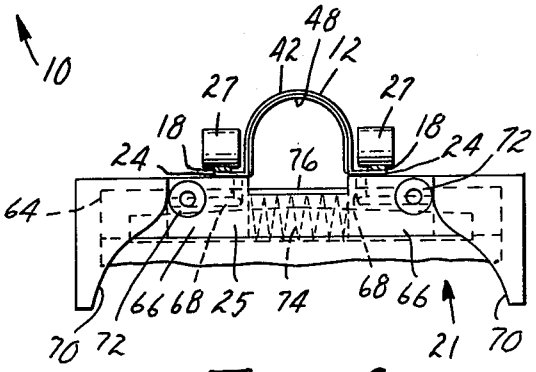
FIGS. 3 and 4 are enlarged fragmentary views taken approximately along lines 3—3 of FIG. 1 which illustrate means for forming and for applying the bails to spaced tapes in the device.
Figure 3:
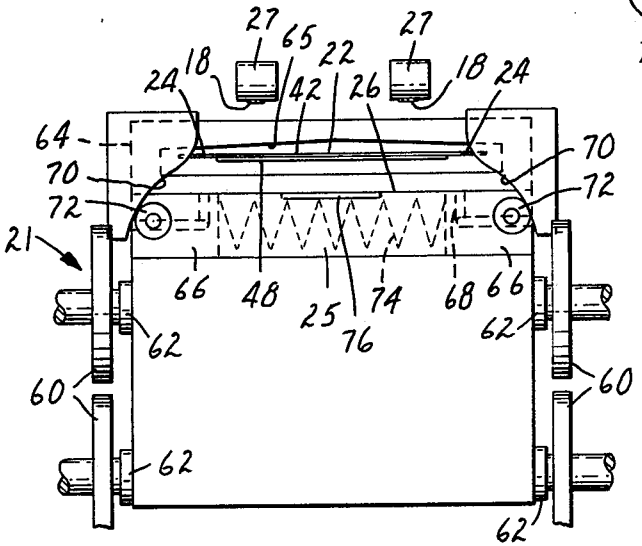

The mechanism 25 carried by the knife 26 which provides means for pressing the surfaces of the end portions of the bails 12 into engagement with the adhesive-coated surfaces of the tapes 18 also provides means for bowing the central portions of the bails 12 as they are pressed into engagement with the tapes 18. The mechanism 25 includes spaced support blocks 66 mounted adjacent the leading edge 67 of the knife 26 for movement along the leading edge 67 of the knife 26 from spaced positions (FIG. 3) at which vacuum ports 68 opening through the leading surfaces of the support blocks 66 will be positioned adjacent the end portions 24 of a bail 12 being formed by severing of the laminate 22 when the blocks 66 are at the slot 65 to engage the end portions 24 of that bail 12 via vacuum applied in the ports 68 and carry that bail 12 with the support blocks 66; and a closed position (FIG. 4) at which the support blocks 66 will be opposite the support rollers 27 to press the end portions 24 of a bail 12 carried by the support blocks 66 against the adhesive-coated surfaces of the parts of the tapes 18 passing over the support rollers 27. Means are provided for moving the support blocks 66 from their spaced to their closed positions as the leading edge 67 of the knife 26 revolves from its position adjacent the slot 65 in the anvil plate 64 to cut the laminate 22 (FIGS. 1 and 3) to its position (FIG. 4) with the support blocks 66 adjacent the support rollers 27. As illustrated, these means are provided by opposed barrel cam surfaces 70 along which cam rollers 72 on the support blocks 66 are guided as the knife edge 68 is revolved from the anvil plate 64 to the support rollers 27 to move the support blocks 66 from their spaced to their closed position in opposition to a return spring 74 which provides means for returning the blocks to their spaced position after they have passed the support rollers 27. Alternately these means could be provided by other structures such as by properly controlled double-acting air cylinders mounted on the knife 26 between the support blocks 66. Movement of the support blocks 66 toward each other will cause the central portion of the bail 12 being carried from the anvil plate 64 to the support rollers 27 to bow. A stop member 76 is located centrally between the support blocks 66 to prevent the center of the bail 12 from bowing toward the knife 26, thereby ensuring that the bail 12 will bow in a direction away from the knife 26.

Figure 2:
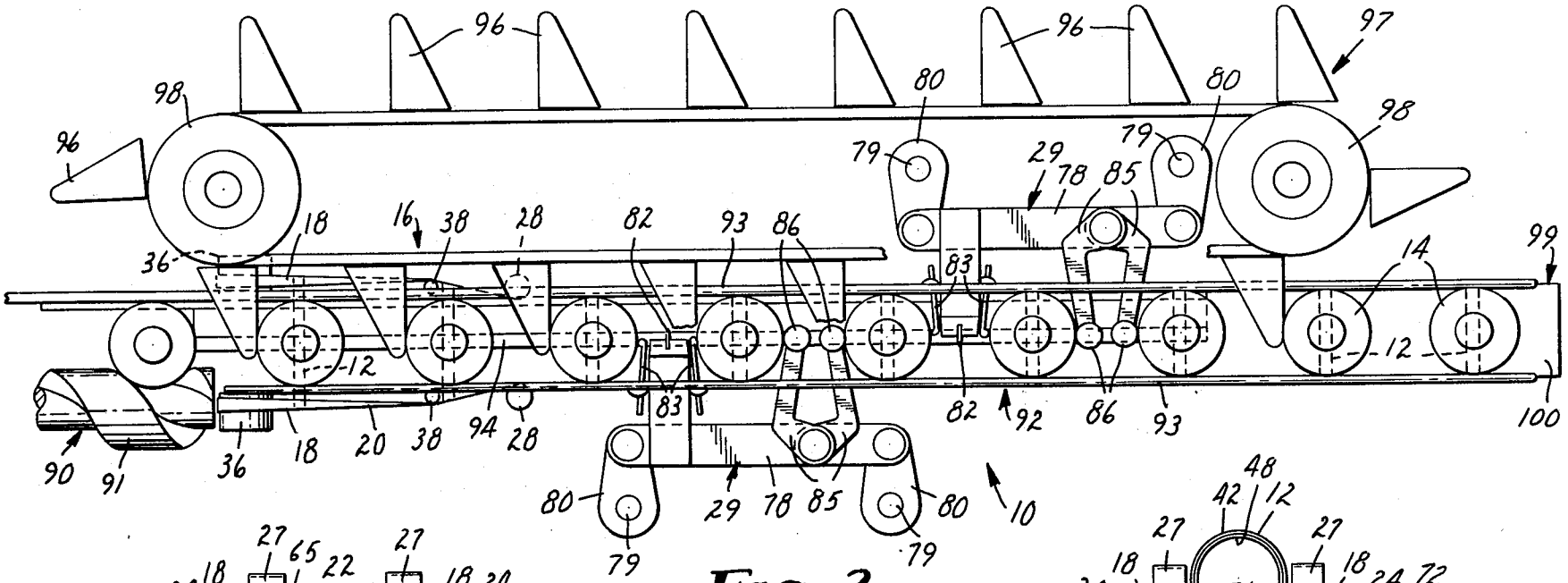
FIG. 2 is a horizontal schematic view of the device and conveyor illustrated in FIG. 1.

The cutting and pressing assemblies 29 included in the means for severing the tapes 18 between the bottles 14 along the conveyor 16 and for pressing the severed portions of tapes 18 into engagement with the bottles 14 are best seen in FIG. 2. The two cutting and pressing assemblies 29 are mounted on opposite sides of the conveyor 16. Each comprises a support bar 78 which is revolved about two parallel shafts 79 via parallel links 80 pivotably mounted between the support bar 78 and shafts 79 to provide timed movement of a knife 82 mounted on the support bar 78 into and out of the spaces between bottles 14 being moved by the conveyor 16. Such movement causes the knife 82 to sever the tape 18 extending between the bottles 14 and causes the distal ends of flexible, resilient wiping members 83 mounted on the bar 78 flanking the knife 82 to press the severed lengths of the tape 18 against the adjacent bottles 14. Each support bar 78 also pivotably supports one end of a pair of arms 85 having rollers 86 at their ends opposite the support bar 78. The arms are spring-biased apart to provide pressure between the rollers 86 and adjacent bottles 14, so that tape ends adhered to the bottles 14 by the wiping members 83 will be firmly pressed into engagement therewith by the rollers 86.

The conveyor 16 for moving the bottles 14 in spaced relationship comprises a first portion 90 in which the bottles 14 are separated and driven in a known manner by the flights of a driven screw-like member 91 which engages around the sides of the bottles 14; and a second portion 92 in which spaced bottles 14 are driven between parallel rails 93 at the sides of the bottles 14 and along a fixed bar 94 providing support for the bottoms of bottles 14, and under which bar 94 the bails 12 applied to the bottles 14 extend. The bottles 14 are driven along the second portion 92 of the conveyor 16 by spaced cleats 96 on a caterpillar-track-like assembly 97 rotatably mounted on and driven by spaced drums 98. A third portion 99 of the conveyor 16 is also provided along which the bottles are driven by an endless belt 100 supported on driven rollers 102. The belt 100 is supported to provide an upwardly traveling inclined portion 104 which collapses the bails 12 against the bottom surfaces of the bottles 14 as the bails 12 are moved from beneath the end of the bar 94, and then engages the bottom surfaces of the bottles 14 to continue their movement along the conveyor 16.

Those skilled in the art will appreciate that many changes could be made in the various structures of the device without departing from the spirit of the present invention. Thus the present invention should not be limited by the schematic structure described herein, but only by the language of the attached claims.

We claim:

1. A device for applying flexible bails to containers being moved in a predetermined spaced relationship by a conveyor, said device comprising:

Means for defining generally parallel paths for two lengths of pressure-sensitive adhesive-coated tape first along first path portions spaced from said conveyor, and then along second path portions with the adhesive coatings on said tapes closely adjacent the opposite sides of the containers and adhered to the containers along a part of the second path portions so that movement of the containers via the conveyor will pull the tapes along their paths;

Means along said first path portions for forming elongate bails of a flexible strip material, said bails having opposite end portions coated with a pressure-sensitive adhesive on one surface;

Means for pressing the surfaces of the end portions opposite said adhesive coatings into engagement with the adhesive coatings on the tapes as the tapes move along said path, and for positioning said bails in predetermined spaced relationships along said tapes to position the end portions of said bails on opposite sides of containers being moved by said conveyor;

Means along said second path portions for pressing the end portions of said bails into engagement with said containers; and Means for severing said tapes between said containers along said conveyor, and for pressing the severed portions of said tapes into engagement with said containers.

2. A device according to claim 1 wherein said means for forming forms bails having a length that is greater than the distance between said parallel lengths of tape along said first path portions, and said means for pressing includes means for bowing said bails as said bails are engaged with said tapes.

3. A device according to claim 1 wherein said means for forming forms said bails from a pressure-sensitive adhesive-coated first web having a width corresponding to the length of said bails and a second web having a width less than said first web, and comprises means for laminating said second web centrally on the adhesive-coated side of said first web material, and means for transversely severing the laminate thus formed to provide said bails.

4. A method for applying flexible bails to containers being moved in a predetermined spaced relationship by a conveyor, said method comprising the steps of defining generally parallel paths for two lengths of pressure-sensitive adhesive-coated tape along first path portions spaced from the conveyor, and then along second path portions with the adhesive coatings on the tapes closely adjacent the opposite sides of the containers and adhered to the containers along a part of the second path portions so that movement of the containers via the conveyor will pull the tapes along their paths;

forming elongate bails of a flexible strip material, the bails having opposite end portions coated with a pressure-sensitive adhesive on one surface;

pressing the surfaces of the end portions opposite their adhesive coatings into engagement with the adhesive coatings on the tapes as the tapes move along the first portion of said path, while positioning said bails in predetermined spaced relationships along the tapes so that the end portions of the bails will be positioned on opposite sides of containers being moved by said conveyor;

pressing the end portions of the bails into engagement with the containers;

severing the tapes between the containers along the conveyor; and pressing the severed portions of the tapes into engagement with the containers.

5. A method according to claim 4 wherein said forming step forms bails having a length that is greater than the distance between the parallel lengths of tape along the first path portions and said pressing step includes the step of bowing the bails as they are engaged with the tapes.

6. A method according to claim 4 wherein said forming step forms the bails from a pressure-sensitive adhesive-coated first web having a width corresponding to the length of said bails and a second web having a width less than said first web, and includes the steps of laminating the second web centrally on the adhesive-coated side of the first web material, and transversely severing the laminate thus formed to provide the bails.

* * * * *